US009962966B2

(12) United States Patent
Chanclon et al.

(10) Patent No.: US 9,962,966 B2
(45) **Date of Patent: *May 8, 2018**

(54) CONTROL OF A PRINT DEVICE

(71) Applicant: HEWLETT-PACKARD DEVELOPMENT COMPANY, L.P., Houston, TX (US)

(72) Inventors: David Chanclon, Cornella de Llobregat (ES); Alberto Borrego Lebrato, Sant Cugat del Valles (ES); Juan Francisco Redondo del Campo, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/674,846

(22) Filed: Aug. 11, 2017

(65) Prior Publication Data

US 2017/0341434 A1 Nov. 30, 2017

Related U.S. Application Data

(63) Continuation of application No. 15/312,630, filed as application No. PCT/EP2014/061404 on Jun. 2, 2014, now Pat. No. 9,776,436.

(51) Int. Cl.
*B41J 13/00* (2006.01)
*B41J 11/42* (2006.01)

(52) U.S. Cl.
CPC ..... *B41J 13/0009* (2013.01); *B41J 11/42* (2013.01)

(58) Field of Classification Search
CPC ..... B41J 11/42; B41J 2/04573; B41J 19/205; B41J 29/38; B41J 13/0009; B41J 29/393; B41J 2/04505; H04N 1/605; H04N 1/00; H04N 1/6019; H04N 1/6058; G06K 15/102; G06K 15/1817; G06K 2215/0017; G06K 2215/0094; G06K 2215/101
See application file for complete search history.

(56) References Cited

U.S. PATENT DOCUMENTS 5,047,957 A * 9/1991 Ikenoue ..... G06F 3/1293 358/1.11
6,170,933 B1 1/2001 Nitta et al.
6,788,324 B2 9/2004 Fisher et al.
7,267,417 B2 * 9/2007 Silverbrook ..... G06K 15/102 347/13

(Continued)

FOREIGN PATENT DOCUMENTS

EP 1334836 8/2003

OTHER PUBLICATIONS

Cho; "An Impact Position Control of the Ink Droplet of Inkjet Printer"; Jun. 2-5, 2005; http://2005.iccas.org/submission/paper/upload/ImpactPosCon_n0_555.pdf.

*Primary Examiner* — Thinh H Nguyen
(74) *Attorney, Agent, or Firm* — HP Inc. Patent Department

(57) ABSTRACT

A method for controlling a print device by generating a firing encoder signal from varying one or more characteristics of a reference signal where the one or more characteristics are varied based on at least the position of a print medium at a reference time. The firing encoder signal is used to synchronize firing of at least one print head of the print device after the reference time.

15 Claims, 5 Drawing Sheets

(56) References Cited

U.S. PATENT DOCUMENTS

| | | | |
|---|---|---|---|
| 7,530,657 | B2 | 5/2009 | Thiessen et al. |
| 7,694,965 | B2 | 4/2010 | Bruhn et al. |
| 2004/0061732 | A1 | 4/2004 | Takeuchi |
| 2006/0017764 | A1 | 1/2006 | Kang et al. |
| 2007/0103496 | A1 | 5/2007 | Otani |
| 2008/0030536 | A1 | 2/2008 | Furukawa et al. |
| 2009/0219552 | A1 | 9/2009 | Igarashi |

* cited by examiner

CONTROL OF A PRINT DEVICE

BACKGROUND

In a print device an image is printed on a print medium. Typically a print device comprises one or more print heads that are arranged to deposit a printing fluid such as ink upon the print medium. The one or more print heads are typically controlled by a print controller. Such a print controller receives an input image to be printed and generates a number of signals to control the print device. Based on these signals the printing fluid is ejected from the one or more print heads. Many print devices incorporate some form of relative movement between the print medium and the one or more print heads so that printing fluid is deposited onto an appropriate area of the print medium. The print controller thus coordinates the timing of the signals needed to control the print device such that an output image is printed in the right place on a print medium.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

Figure 1:
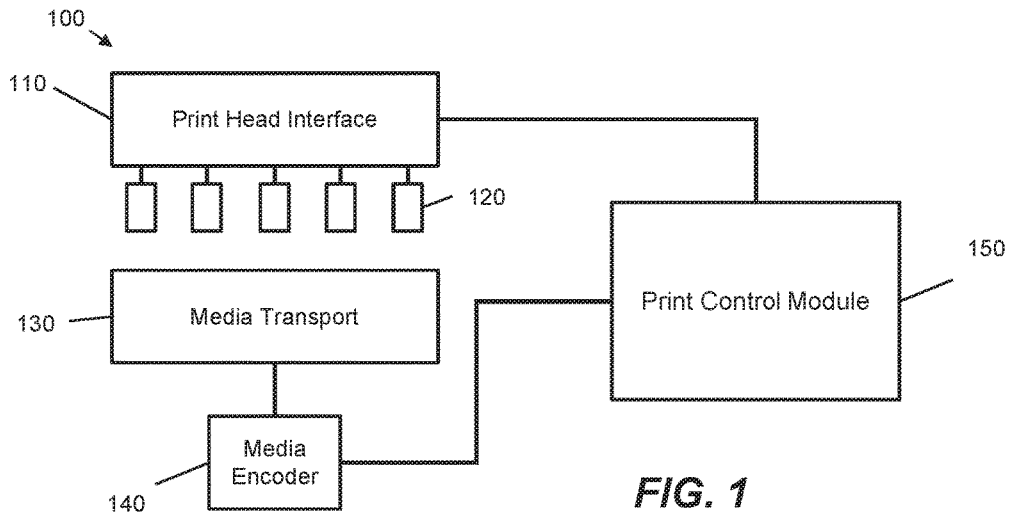
FIG. 1 is a schematic diagram showing components of a printing system.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Certain examples described herein relate to printing systems and methods of printing. In particular, certain examples relate to ink-jet printing systems that move a print medium in relation to one or more ink-jets. The movement may be due to the movement of an ink-jet across the width of the print medium, or in the case of page-wide array printing, the movement of the medium itself through an ink-jet running across the width of the medium. The ink-jet is generated by ejecting ink from one or more print heads of the printing system. The firing of said print heads may be controlled by controlling the ejection of ink from one or more nozzles of the print head. A nozzle may comprise an ink chamber and a piezoelectric element, wherein activation of the piezoelectric element via a firing pulse ejects ink from the chamber and through the nozzle. Nozzles may be arranged according to print dies, e.g. portions of common silicon substrate.

In these cases, the printing system, or in some cases an external control system, generates a firing pulse signal that controls the deposit of ink on print media. The firing pulse signal has a particular timing or frequency. To achieve high print quality and/or minimize any print errors it is desirable that the firing pulse signal is synchronized with the relative movement of a print medium. This may comprise synchronizing the timing of a firing pulse signal with the movement of the print medium in respect of the one or more ink-jets.

In an example printing system, a media transport system ("media transport" for short) may be arranged to transport print media relative to a print head. In a page-wide array printer, one or more print heads may be mounted on a print bar above a media transport path. In these cases the media transport may transport a print medium underneath the print heads. In certain cases, the media transport may comprise a system that moves the one or more print heads in relation to a print medium; in other cases a combination of print head and print media movement may be effected.

In examples, a state of a media transport may be determined using one or more encoders. Depending on the system these may comprises one or more linear and/rotary encoders. For example, if the media transport comprises one or more rollers, and/or a belt system, a rotary encoder may be coupled to one of the roller or a drive mechanism such as an electric motor. In these cases, the print medium may be carried by the rollers and/or belt under the print heads. In another case, a linear encoder may track the print media as it moves along a linear path. In both cases the encoders will generate an encoder signal representative of the media transport state. This encoder signal may be used to synchronize one or more firing pulse signals.

In comparative examples, fluctuations and deviations from normal operating properties, such as roller and/or belt vibrations due to high-speed operation, may lead to fluctuations in the media transport signal. This can be problematic for synchronize one or more firing pulse signals. In further comparative examples, other fluctuations and deviations such as slippage of a print medium in respect of the media transport and/or media-specific fluctuations such as curling or snagging cause the firing pulse signal frequency to be out of synch with the encoder signal.

Certain methods and systems described herein seek to minimize the impact of printing errors that arise due to fluctuations and deviations from normal operating properties. Certain methods described herein re-synchronize one or more firing pulse signals to the position of print media using a predictive position following method. This helps to overcome the effects of fluctuations and maintain print quality.

FIG. 1 shows an exemplary printing system 100. Certain examples described herein may be implemented within the context of this printing system, In the example of FIG. 1, one or more print heads 120 may be arranged to deposit printing fluid on a print medium through nozzles adjoined to the print heads. The print heads are communicatively coupled to a print head interface 110. Print heads 120 may be arranged across the width of a media as in a page wide array printer, or may be arranged in a traditional ink-jet printer, whereby the cartridge is moved across the width of the page itself. The print head interface 110 is arranged to receive a firing pulse signal from print control module 150.

In FIG. 1 media transport 130 is arranged to transport a print medium in relation to the print heads 120. Media transport 130 is coupled to a media encoder 140 which is arranged to capture one or more properties of the media transport 130 and generate a signal. The signal may be representative of one or more of a state of the media transport 130 or a state of a print medium being transported by the media transport. In one example, the media encoder 140 generates an encoder signal which is indicative of the movement of the print media with respect to the media transport. In certain cases, the media encoder signal may be processed to take into account one or more media properties of a print media, e.g. size, material and/or weight as determined from print configuration data. Print control module 150 is arranged to receive an encoder signal from the media encoder 140 and generate a firing pulse signal which may be sent to the print head interface. The firing pulse signal controls the firing of the nozzles of the one or more print heads 120. Print control module 150 is arranged to synchronize the firing pulse signal with the encoder signal received from the media encoder 140. In one example, print control module 150 is arranged to minimize an error between a position of the print medium based on a timing for the firing pulse signal and a position of the print medium predicted from the encoder signal, In certain cases, print control module 150 additionally processes the received encoder signal, prior to synchronizing the firing encoder signal. For example in certain cases the encoder signal may comprise an encoder signal from one or more of a rotary and linear encoder. In these cases the encoder signal may be processed by one or more of the media encoder 140 and the print control module 150 to generate a media encoder signal. The media encoder signal may comprise a processed form of the encoder signal, The processing may remove noise from the encoder signal. The processing may also or alternatively comprise filtering and/or calibrating the encoder signal based on one or more hardware and/or media properties parameters. For example, if the media transport 130 comprises one or more rollers, then processing of encoder signals may incorporate properties such as roller diameter and run-out as well as other media-specific properties. In certain cases, a media encoder signal comprises one or more of a position and a speed of a print medium being transported by the media transport 130.

Figure 2:
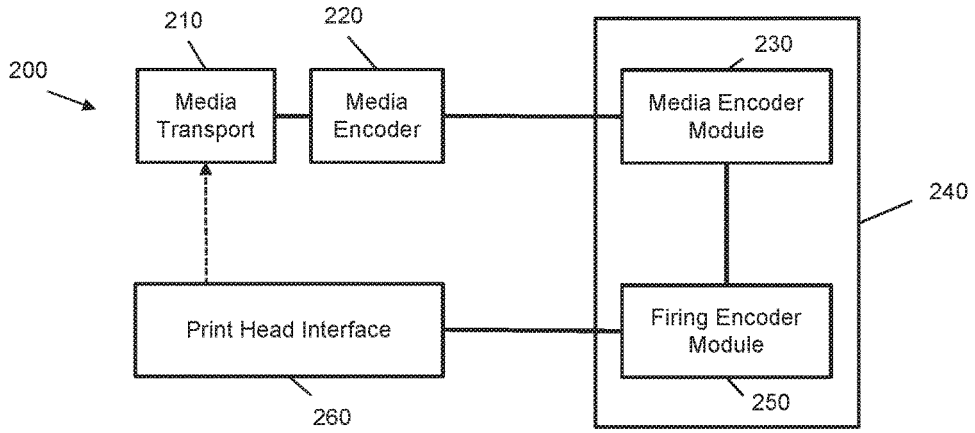
FIG. 2 is a schematic diagram showing components of a print control module according to an example.

FIG. 2 shows the components of a printing system 200 according to one example, In one case these components correspond to the respective components of FIG. 1. Print control module 240 comprises a media encoder module 230 and firing encoder module 250. Media encoder 220 generates a signal as in the case of media encoder 140 in FIG. 1. Media encoder module 230 is arranged to receive a signal from media encoder 220 communicatively coupled to media transport 210. Again, media encoder 220 may comprise a rotary encoder with and/or without additional processing. In the latter case, additional processing may be performed by the media encoder module 230. The processing may comprise the implementation of a Savitzky-Golay filter, e.g. in real time.

In FIG. 2, firing encoder module 250 is coupled to print head interface 260 and is arranged to synchronize a firing encoder signal with a media encoder signal received from media encoder module 230. The firing encoder signal is a second, separate encoder signal from the media encoder signal that is used to generate a firing pulse signal for the print heads; in particular, the firing encoder signal controls the timing of the firing pulse signal. In one embodiment, the firing encoder module 250 synchronizes a future position of the print media as predicted using the media encoder signal with a future position of the print media as predicted using the firing encoder signal. In more detail, the firing encoder signal may be synchronized by modifying its time period. In this case, the time period represents a movement of the print medium over a predetermined distance, e.g. one line with 150 lines per inch (1/150"—approximately 0.17 mm). The time period is modified by the firing encoder module 250 such that a position of the print medium that is predicted from the firing encoder signal at the end of its time period matches a position of the print medium at the end of the time period that is predicted from the media encoder signal.

Figure 3:
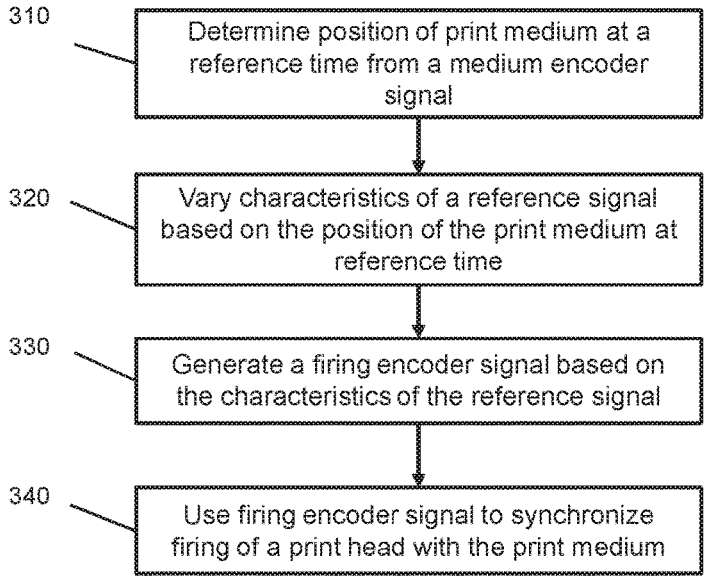
FIG. 3 is a flowchart showing a method of controlling a print device according to an example.

A number of methods will now be described. The methods described in herein may be implemented on the systems described in FIGS. 1 and 2. FIG. 3 shows a method for generating a firing encoder signal that may be used to synchronize firing of a print head with a print medium, according to one example. At block 310 a position of a print medium is determined at a reference time. According to one example, the motion of the print medium is controlled by a media transport such as that of FIGS. 1 and 2. In another example, the print medium is itself stationary, and the position of the print medium is given in relation to a movable print head and print head interface. The reference time may be taken to be any time from which a measurement is made. The reference time may comprise a reference point from which all measurements are given, either deterministically or predicted.

At block 320 characteristic properties of a reference signal are varied based on the position of the print medium at the reference time. In one example, the reference signal corresponds to a previously-generated firing encoder signal, as such this block may comprise varying one or more characteristics of the previously-generated firing encoder signal. The one or more one or more characteristics may comprise a timing period or signal frequency. Alternatively, the reference signal may be generated independently and received by a system implementing the method of FIG. 3. In certain cases, the reference signal has a time period representing a movement of the print medium over a predetermined distance (e.g. 1/150"—approximately 0.17 mm in one implementation).

At block 330, a firing encoder signal is generated for a time after the reference time, based on the varied characteristics of the reference signal. In the case where the reference signal has a time period representing a movement of the print medium of a predetermined distance, generating the firing encoder signal may comprise determining an error between a predicted distance moved by the print medium based on at least the determined position of the print medium at the reference time and the predetermined distance. The error determined can then be used to vary the time period of the reference signal to generate a firing encoder signal.

At block 340 the firing encoder signal generated at block 330 is used to synchronize the firing of print heads with a print medium.

Figure 4:
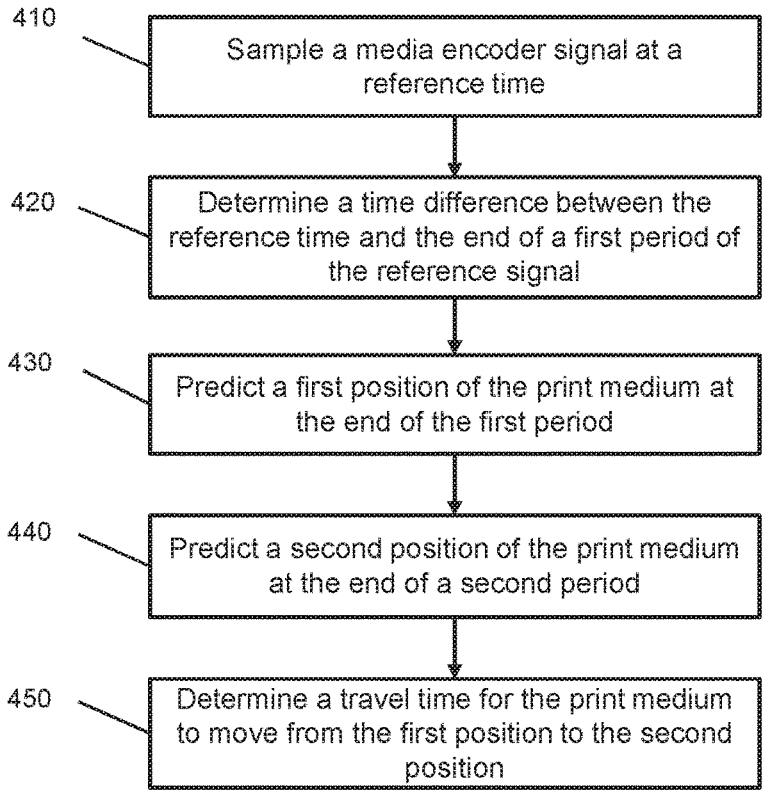
FIG. 4 is a flowchart showing a method of determining a travel time of a print medium according to an example.

FIG. 4 shows an example position follower method which may be implemented by the systems shown in FIGS. 1 and 2. This position follower method may be used to determine a time period for a firing encoder signal. The position follower method applies the constraint that a position of a print medium as predicted from a modified firing encoder signal matches the position of the print medium as determined from a media encoder signal. In these cases the firing encoder signal is a repeating waveform such as a saw-tooth or square wave.

At block 410 a media encoder signal is sampled. In one example sampling may comprise latching a processed encoder signal at an incremental time period, e.g. every 0.4 ms. At block 420 a time difference between the reference time and an end of a first period of the reference signal is determined. At block 430, the time difference calculated at the previous stage is used to predict the position of the print medium at the end of the first period. This prediction is performed based on an initial position and speed at reference time, for example as determined from the media encoder. In one case the media encoder signal has a value that is representative of a position of the print medium; in this case the speed may be determined by taking the derivative of this signal. At block 440 a position of the media at the end of a second period from the reference signal is predicted. This may be estimate based on the travel distance assumed by firing encoder signal (e.g, 0.17 mm) and a time difference between the reference time and the subsequent start of the second period (e.g. 0.17*(time_difference/time_period)). At block 450, the travel time for the print medium to move from the first position to the second position can be determined from previously determined values. For example, the difference in the positions determined at blocks 440 and 430 can be determined and divided by the speed at the reference time that was used in block 430. This travel time may then be used to set the time period of the firing encoder signal waveform.

Figure 5:
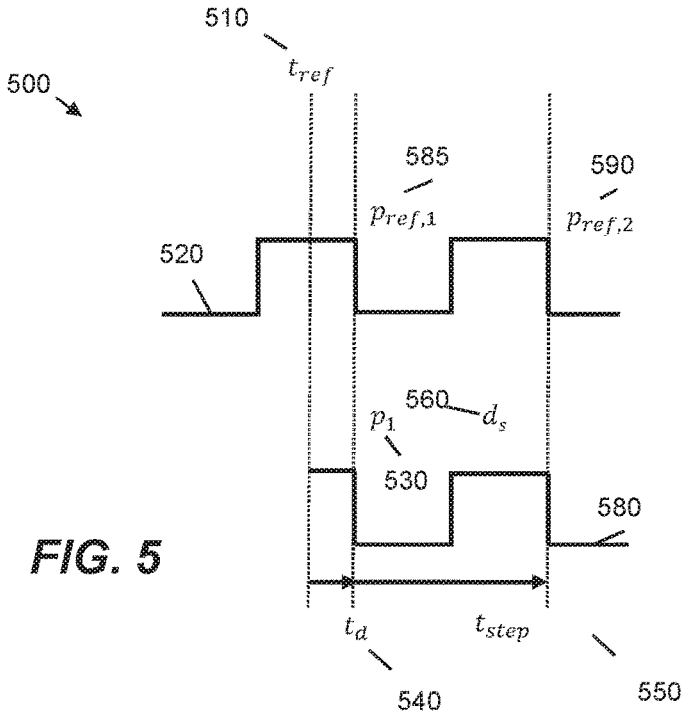
FIG. 5 is a timing waveform diagram showing a number of control signals according to an example

FIG. 5 is a waveform diagram that may be used to illustrate the method of FIG. 4 according to one example. FIG. 5 shows a reference signal 520, represented as a square wave. This is the reference signal from which a firing encoder signal may be generated. The media encoder signal 570 is represented by the dotted line 570. In certain cases the media encoder signal 570 may comprise a position value. A future firing encoder signal 580 to be generated is shown with a time period $t_{step}$ that is calculated by varying one or more properties of the reference signal 520 as discussed below.

Block 410 of FIG. 4 takes place at time $t_{ref}$ 510. Here a value is taken from the media encoder signal 570. This value may comprise an initial position $p(t_{ref})$ at time $t_{ref}$ of the media. A velocity $v(t_{ref})$ may then be determined by differentiating the media encoder signal 570. Next a time $t_d$ 540 until the end of the first reference signal step can be determined, since the reference signal 520 according to the example, has a known period. At this time, the estimated position of the media according to the media encoder signal 570 can be predicted as:

$$p_1=p(t_d)=p(t_{ref})+v(t_{ref})\times t_d.$$

Following this the second position of the print media 590 as predicted by the reference signal 520 can be determined as:

$$p_{ref,2} = p_{ref,1} + \frac{1}{l}$$

where l is the resolution of the one or more printing heads and $p_{ref,1}$ 585 is the position of the print media at $t_d$ as predicted by the reference signal. For example, I may equal 150 (e.g. 150 lines per inch); in a metric equivalent 1/I may equal $0.17\times10^{-3}$. The position $p_{ref,1}$ 585 may be determined using the known travel distance in one period (e.g. 0.17 mm) and multiplying it by a proportion of the complete time period taken up by $t_d$ .The distance to synchronize $d_s$ 560 the media according to the distances determined from the media encoder signal and the reference signal can be determined as:

$$d_s=p_{ref,2}-p_1.$$

From which a travel time for the print medium to move from the first position to the second position can be determined as:

$$t_{step} = \frac{d_s}{v(t_{ref})}$$

The travel time determines the required time period of a firing encoder signal, to synchronize with the position of a print media. The methods enclosed above are used to resynchronize the position of the print media with the firing encoder signal and not the velocity of the media.

Figure 6:
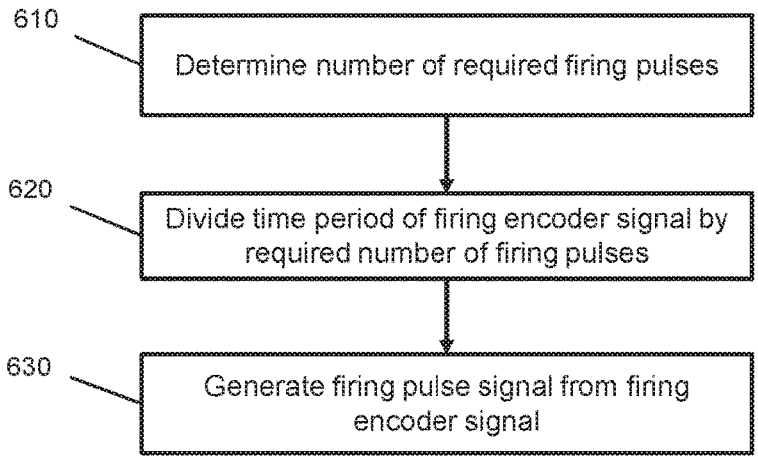
FIG. 6 is a flowchart showing a method for generating a firing pulse signal according to an example.

FIG. 6 shows a method, according to one example, of determining a firing pulse from a firing encoder signal. This method may be used in conjunction with previous methods outlined for determining a firing encoder signal, or may be applied to a signal derived from a firing encoder signal. At block 610 the number of required firing pulses is determined. At block 620, the time period of a firing encoder signal is divided according to the required number of firing pulses. At block 630, the firing pulse signal is generated from the firing encoder signal. The firing pulse signal may be generated by a firing encoder module, such as the firing encoder module 250 of FIG. 2, or may be generated at print head interface 260, receiving a firing encoder signal.

Figure 7:
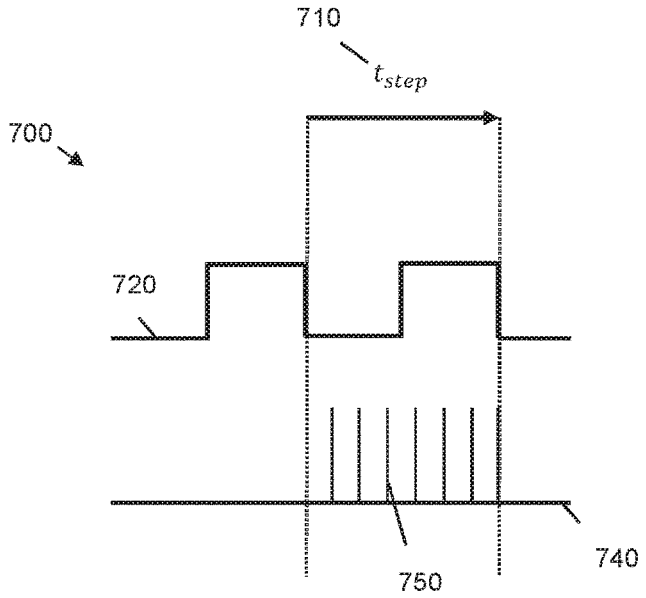
FIG. 7 is a timing waveform diagram showing the generation of a firing pulse train according to an example.

FIG. 7 shows a diagram of signals 700 as may be determined by the methods disclosed herein, FIG. 7 shows a modified firing encoder signal 720 and a firing pulse signal 740. The firing pulse signal comprises a number of firing pulses 750, which represent a division of the firing encoder signal 740. In certain embodiments it may be possible to have exactly one firing pulse per firing encoder step, e.g. in certain cases the firing encoder signal may comprise the firing pulse signal. As shown in the previous Figure, $t_{step}$ is the period of the firing encoder signal which has been determined based on the properties of the media encoder signal and a reference signal, Certain methods and systems described herein differ from comparative methods that synchronize one or more firing pulse signals based on a velocity of the print media determined from one or more encoder signals. If synchronization is based on the velocity of the print media then this results in the accrual of additional positional error due to the fact that there exists a delay between measuring the velocity of the media and modifying the firing pulse signal in response to that measurement. Consequently, this leads to an additional, undesirable printing error.

Certain methods and systems disclosed herein mitigate the effects of positional errors by modifying the firing pulse signal based on a position follower method as opposed to a velocity follower method, Certain examples described herein can be used to improve print quality. The solution of correcting firing pulse signals based on the position of a print media, as opposed to the speed of a media provide greater printing robustness. For example in the case of page-wide array printing, the levels of mismatch in a print using the methods disclosed herein are reduced considerably. In those circumstances, increased fluctuations and perturbations due to the printing being in the media axis as opposed to across the width of the page in the scan axis can lead to increased print defects and print medium/nozzle misalignment. The systems disclosed herein can be used to reduce the impact of these fluctuations.

Figure 8:
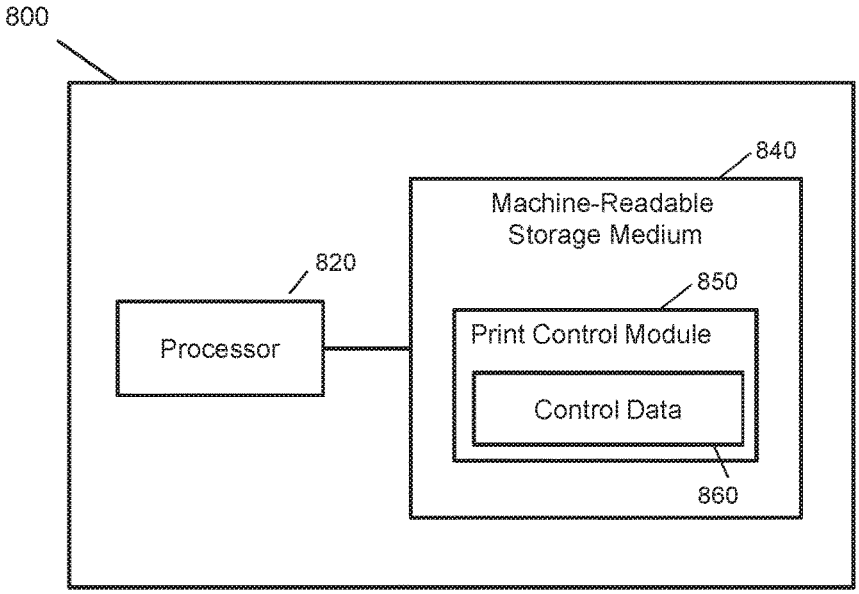
FIG. 8 is a schematic diagram showing an exemplary computer system according to an example.

Certain methods and systems as described herein may be implemented by a processor that processes program code that is retrieved from a non-transitory storage medium. FIG. 8 shows an example 800 of a device comprising a machine-readable storage medium 840 coupled to a processor 820. The device may comprise a computer and/or a printing device. Machine-readable media 840 can be any media that can contain, store, or maintain programs and data for use by or in connection with an instruction execution system. Machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc. In FIG. 8, the machine-readable storage medium comprises program code to implement a print control module 850 as in the foregoing examples described herein, and data representative of one or more print control data streams 860.

Similarly, it should be understood that a controller may in practice be provided by a single chip or integrated circuit or plural chips or integrated circuits, optionally provided as a chipset, an application-specific integrated circuit (ASIC), field-programmable gate array (FPGA), etc. For example, this may apply to all or part of a controller or other printer control circuitry. The chip or chips may comprise circuitry (as well as possibly firmware) for embodying at least a data processor or processors as described above, which are configurable so as to operate in accordance with the described examples. In this regard, the described examples may be implemented at least in part by computer program code stored in (non-transitory) memory and executable by the processor, or by hardware, or by a combination of tangibly stored code and hardware (and tangibly stored firmware).

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of controlling a print device comprising:

determining, at a reference time, a position of a print medium within the print device based on a media encoder signal;

generating a firing encoder signal by varying characteristics of a reference signal based on the position of the print medium at the reference time, the characteristics being varied such that a position of the print medium predicted using the varied characteristics matches a position of the print medium predicted using the media encoder signal and the firing encoder signal being used to synchronize firing of a print head of the print device after the reference time.

2. The method of claim 1, further comprising:

defining a time period for the reference signal representing a movement of the print medium over a predetermined distance and generating a firing encoder signal comprises:

determining an error between a predicted distance moved by the print medium based on the determined position of the print medium at the reference time and the predetermined distance; and using the error to vary the time period of the reference signal to generate the firing encoder signal.

3. The method of claim 1, further comprising:

receiving a rotary encoder signal from a media transport of the print device; and processing the rotary encoder signal to generate the media encoder signal, the media encoder signal representing a speed of the print medium, said processing comprising calibrating for a media type of the print medium.

4. The method of claim 1, comprising:

sampling the media encoder signal, the reference time comprising a time at which the media encoder signal is sampled;

determining a time difference between the reference time and an end of a first period for the reference signal;

predicting a first position of the print medium at the end of the first period based on the time difference and the determined position;

predicting a second position of the print medium at the end of a second period for the reference signal; and determining a travel time for the print medium to move from the first position to the second position, generating the firing encoder signal based on the travel time.

5. The method of claim 4, comprising:

determining a speed of the print medium; and using the speed of the print medium to predict the first position of the print medium and to determine the travel time.

6. The method of claim 1, further comprising receiving a previous firing encoder signal as the reference signal.

7. The method of claim 1, comprising:

generating a firing pulse signal for the print head using the firing encoder signal, the firing pulse signal having a time period determined by dividing a time period for the firing encoder signal by a number of required firing pulses.

8. A method comprising:

with a media encoder, sampling a media encoder signal at a reference time;

with a processor:

determining a time difference between the reference time and an end of a first period of the media encoder signal;

predicting a first position of a print medium within a print device at the end of the first period;

predicting a second position of the print medium at an end of a second period;

determining a travel time for the print medium at the end of the second period; and generating a firing encoder signal based on the predicted position of the print medium predicted using the media encoder signal.

9. The method of claim 8, further comprising:

determining an error between the predicted second position of the print medium at the end of the second period and predicted position of the print medium; and using the error to vary the firing encoder signal.

10. The method of claim 8, wherein the reference time comprises a time at which the media encoder signal is sampled, the method further comprising generating the firing encoder based on the travel time.

11. The method of claim 10, comprising:

determining a speed of the print medium; and using the speed of the print medium to predict the first position of the print medium and to determine the travel time.

12. The method of claim 8, comprising:

generating a firing pulse signal for the print head using the firing encoder signal, the firing pulse signal having a time period determined by dividing a time period for the firing encoder signal by a number of required firing pulses.

13. A method comprising:

determining a number of firing pulses within a firing pulse signal;

dividing a time period of a firing encoder signal by the number of firing pulses within the firing pulse signal; and generating a firing pulse signal from the firing encoder signal.

14. The method of claim 13, further comprising:

determining a position of a print medium at a reference time from a medium encoder signal;

varying characteristics of the reference signal based on the position of the print medium at the reference time;

generating the firing encoder signal based on the characteristics of the reference signal; and using the firing encoder signal to synchronize firing of print head with the print medium.

15. The method of claim 14, further comprising synchronizing the firing encoder signal by modifying a time period of the firing encoder signal, such that a position of a print medium at an end of the time period that is predicted from the firing encoder signal matches a position of the print medium at the end of the time period that is predicted from the media encoder signal.

* * * * *